United States Patent [19]

Oba

[11] Patent Number: 4,677,267

[45] Date of Patent: Jun. 30, 1987

[54] LATCHING MECHANISM FOR SWITCH

[75] Inventor: Hiroki Oba, Furukawa, Japan

[73] Assignee: Alps Electric Co., Ltd., Japan

[21] Appl. No.: 930,037

[22] Filed: Nov. 10, 1986

Related U.S. Application Data

[63] Continuation of Ser. No. 674,545, Nov. 26, 1984, abandoned.

[30] Foreign Application Priority Data

Nov. 21, 1983 [JP] Japan ..... 58-178725[U]

[51] Int. Cl.[4] ..... H01H 13/56

[52] U.S. Cl. ..... 200/153 J; 200/5 A; 200/159 R

[58] Field of Search ..... 200/153 J, 5 A, 328, 200/159 R

[56] References Cited

U.S. PATENT DOCUMENTS

| | | | |
|---|---|---|---|
| Re, 27,963 | 4/1974 | Schadow | 200/159 R |
| 4,218,598 | 8/1980 | Iwasaki et al. | 200/153 J |
| 4,249,053 | 2/1981 | Tsutsui | 200/153 J |
| 4,360,721 | 11/1982 | Niinuma | 200/153 J |
| 4,383,153 | 5/1983 | Kondo et al. | 200/153 J |
| 4,531,026 | 7/1985 | Terajima et al. | 200/5 R |
| 4,531,032 | 7/1985 | Murata | 200/153 J |
| 4,585,914 | 4/1986 | Ohashi et al. | 200/284 |

*Primary Examiner*—Stephen Marcus
*Assistant Examiner*—Ernest G. Cusick
*Attorney, Agent, or Firm*—Guy W. Shoup

[57] ABSTRACT

A latching mechanism for use in a switch such as a push switch comprises a slider capable of sliding in the casing of the switch, a spring for biasing the slider in one direction, and a driving pin disposed in the direction of movement of the slider and acting to move a movable contact relative to fixed contacts. Both ends of the pin are bent such that the pin assumes a U-shaped form. One of these ends is anchored to a hooked element so as to be horizontally rotatable. The other end is received in a heart-shaped cam groove, and is held into engagement with the bottom of the groove.

2 Claims, 8 Drawing Figures

LATCHING MECHANISM FOR SWITCH

This is a continuation application from application Ser. No. 674,545 filed Nov. 26, 1984 now abandoned.

FIELD OF THE INVENTION

The present invention relates to a latching mechanism used in a switch such as a push switch and, more particularly, to a latching mechanism for holding a slider of the switch in a latched condition and then allowing the slider to be unlatched and returned to its original position.

BACKGROUND OF THE INVENTION

An example of such a latching mechanism used in a convetional push switch shown in FIGS. 1–5. A casing 5 for the push switch receives a slider 1 received partially within the casing 1. The upper portion of the slider has a heart-shaped cam groove 1*a* and the lower portion forms a receiving portion 1*f* adapted to receive and retain movable contacts 4. The casing 5 of the switch has an opening 5*a* at its one end, and the receiving portion 1*f* is mounted in the casing 5 so as to be slidable. The movable contacts 4 received in the receiving portion 1*f* can be brought into sliding contact with fixed contacts 7, three on each side, extending vertically from an insulating plate 6 which is mounted to the bottom of the casing 5. The switch is so designed that as the slider moves, the manner of connection of the movable contacts with the three pairs of fixed contacts changes. The slider 1 is always biased in the direction indicated by the arrow B in FIG. 4 by a spring 8 whose outer end is held to the outer end of the slider. The inner end of the spring 8 is held to a retaining portion 5*b* formed on the front wall of the casing 5.

A driving pin 2 in the shape of a crank is disposed in the direction of movement of the slider 1. A hole 5*c* is formed in the top portion of the casing 5. A base plate 9 which is mounted to the underside of the top portion of the casing 5 is provided with a hole 9*a* extending through the plate. One end 2*a* of the pin 2 extends through the hole 9*a*, and is pivotally held in the hole 5*c*. The pin 2 further includes an intermediate portion 2*b*, and another end 2*c* is received in the cam groove 1*a* in the slider 1. The end 2*c* is biased into the cam groove by the leaf spring 3 formed by part of the base plate 9. The spring 3 is centrally provided with an elongated rib 3*a* which is disposed substantially perpendicularly to the longitudinal direction of the pin 2 when the base plate 9 is installed in the casing 5, in order to bias the pin 2 toward the slider.

In the single-acting mechanism used in the push switch constructed as described above, when the slider 1 is pushed inwardly in the direction indicated by the arrow A against the resilience of the spring 8 when the end 2*c* of the driving pin 2 lies at a position f of the cam groove, as shown in FIG. 3, the end 2*c* moves up along an inclined surface of the cam groove and reaches the position a. Further inward movement of the slider results in the end 2*c* of the pin falling downwardly at a step 1*b* to arrive at a position b. Since the pin 2 is biased in a direction indicated by the arrow D by the leaf spring 3, the end 2*c* moves from the position a to the position b without moving from the position a directly to the position d. Thereafter, the inward pressure on the slider is released and the slider 1 is latched in position as the end 2*c* reaches the position c. Upon the next inward movement of the slider, the end 2*c* of the pin falls at steps 1*c*, 1*d*, and 1*e* and passes across positions d and e. Finally, the pin returns to the original position f. As the slider 1 moves in this way, the movable contact 4 slides across the fixed contacts 7. Thus, the contact positions of the movable contact 4 with the three pairs of the fixed contacts 7 changes, thereby performing a switching action.

In the latching mechanism in the conventional switch constructed as thus far described, one end 2*a* of the driving pin 2 extends through the hole 9*a* in the base plate 9 and is pivoted in the hole 5*c* formed in the top portion of the casing 5, whereas the other end 2*c* is received in the heart-shaped cam groove 1*a* in the slider 1 and biased by the leaf spring 3 fabricated from the base plate 9. Therefore, the pin 2 is required to have a cranklike form. Further, since the pin 2 is shaped like a crank and has an end disposed upright from the direction of movement of the slider, it is necessary to make the height of the casing 5 equal to the height of the pin 2. These limitations have made it considerably difficult to fabricate the push switch employing such a locking mechanism into a small-sized or thin structure.

In addition, when the driving pin 2 is inserted into the hole 9*a* in the base plate 9 and mounted into the hole 5*c* formed in the top portion of the casing 5, one end 2*a* of the pin 2 must be inserted into the hole 5*c* in accordance with the procedures illustrated in FIG. 5 before it is mounted in the top portion. Thus, the assembly operation involves many steps. Accordingly, the mechanism is fabricated in an inefficient way, increasing costs.

SUMMARY OF THE INVENTION

In view of the foregoing problems with the prior art mechanism, it is the object of the present invention to provide a mechanism that is free of such problems.

This object is achieved in accordance with the teachings of the invention by a latching mechanism comprising a substantially U-shaped driving pin whose one end is horizontally and rotatably anchored to a hooked, retaining member mounted in the casing of the switch, the other end of the driving pin extending to the bottom of a heart-shaped cam groove.

DETAILED DESCRIPTION OF THE INVENTION

Figure 1:
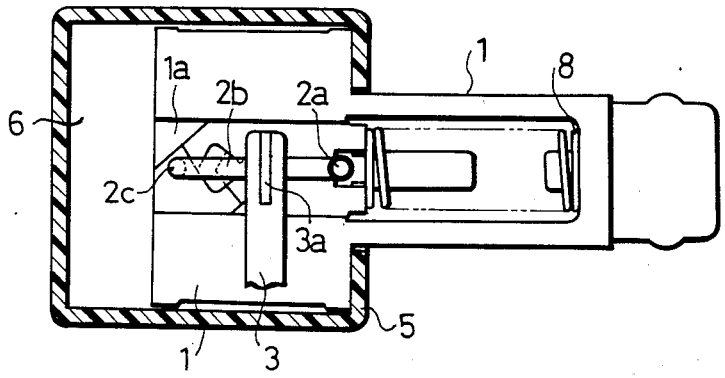
Fig. 1 PRIOR ART
FIG. 1 is a plan view of the main portion of a latching mechanism in a conventional switch.
Figure 2:
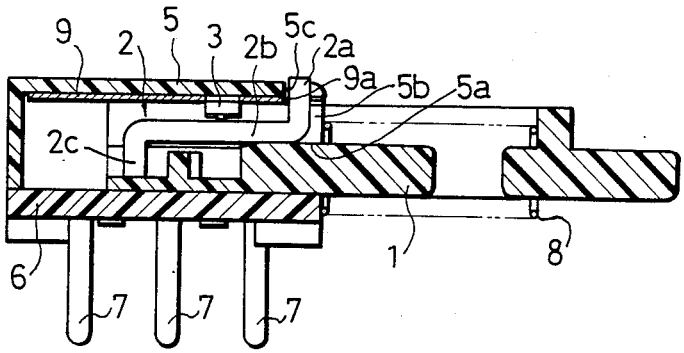
Fig. 2 PRIOR ART
FIG. 2 is a cross-sectional view of the main portion of the mechanism shown in FIG. 1.
Figure 3:
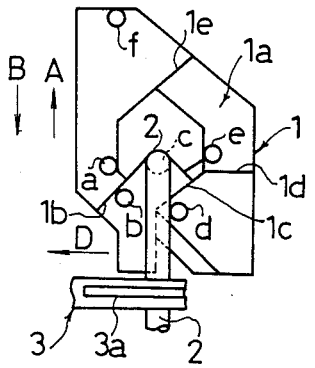
Fig. 3 PRIOR ART
FIG. 3 is a plan view of the heart-shaped cam groove in the mechanism shown in FIG. 1.
Figure 4:
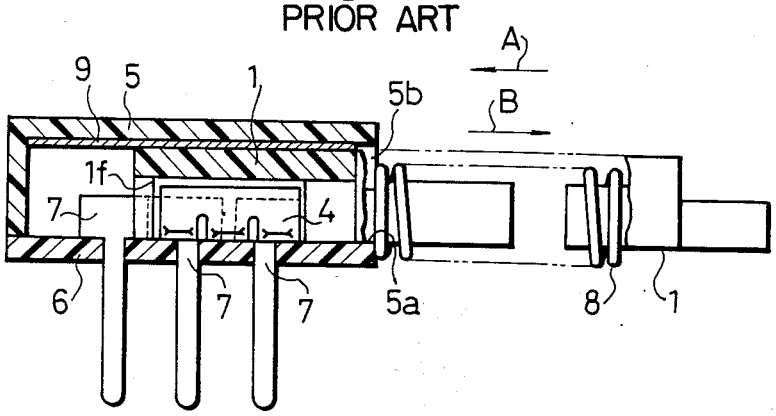
Fig. 4 PRIOR ART
FIG. 4 is a cross-sectional view of a push switch employing the latching mechanism shown in FIG. 1.
Figure 5:
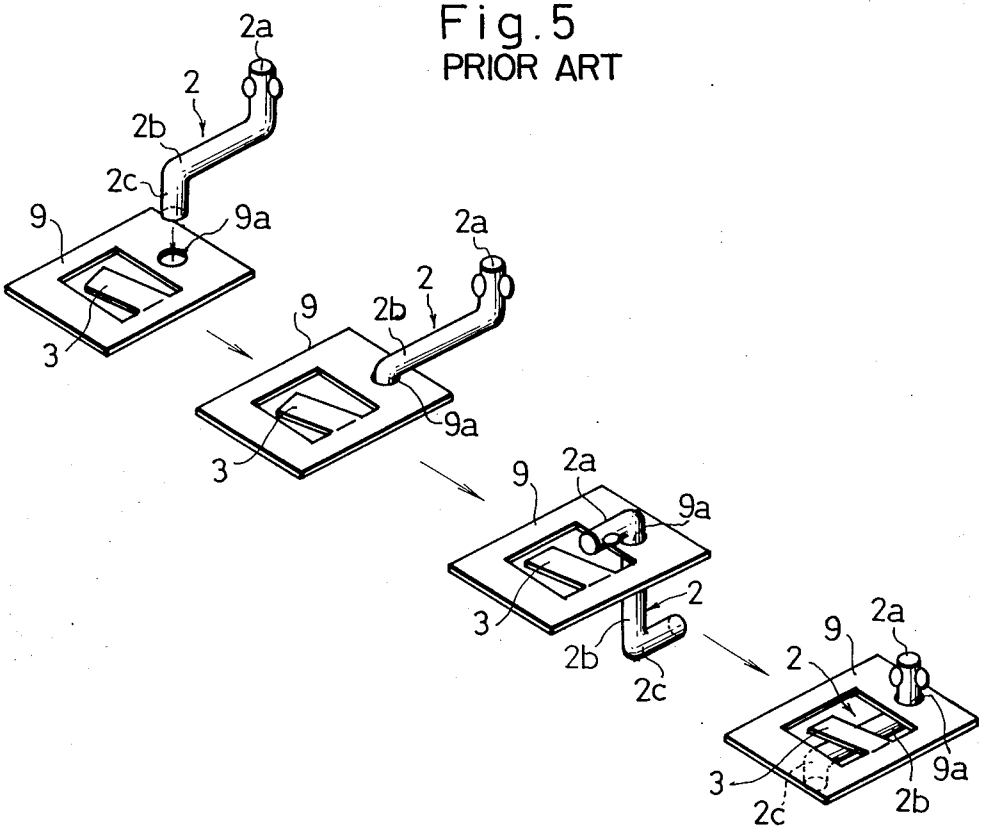
Fig. 5 PRIOR ART
FIG. 5 is a perspective view illustrating the manner in which the driving pin shown in FIG. 1 is mounted into a base plate.
Figure 6:
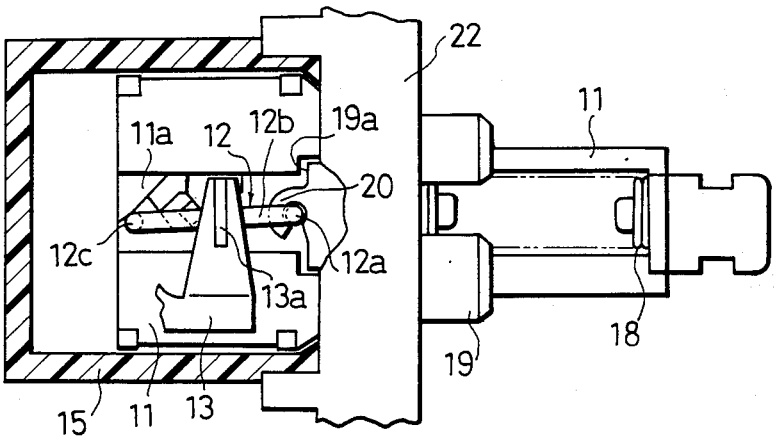
FIG. 6 is a plan view of the main portion of a latching mechanism used in a switch according to the present invention.
Figure 7:
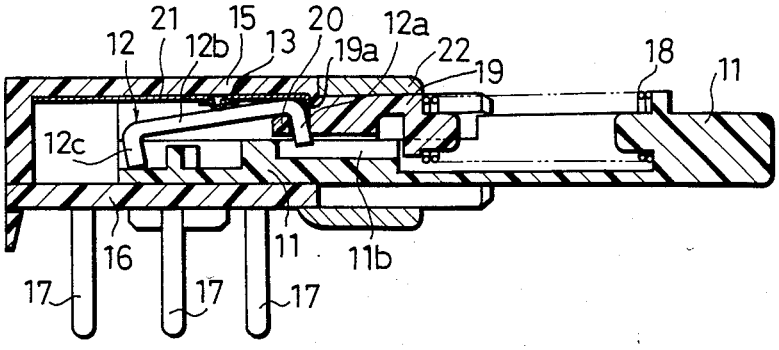
FIG. 7 is a cross-sectional view of the main portion of the mechanism shown in FIG. 6.
Figure 8:
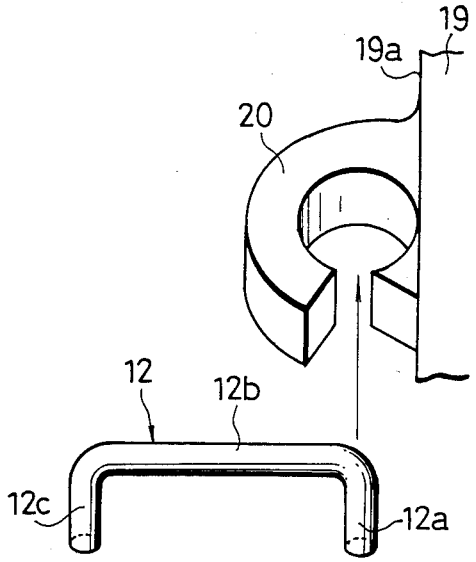
FIG. 8 is a perspective view showing the relation between the driving pin and the pin-retaining element of the mechanism shown in FIG. 6.

Referring to FIGS. 6–8, there is shown a latching mechanism embodying the concept of the present invention. This mechanism includes a slider 11, a driving pin 12, and a leaf spring 13. The slider 11 is provided with a heart-shaped cam groove 11*a*. The switch in which the present mechanism is used includes a casing 15 having an insulating plate 16 attached to its bottom. Movable contacts (not shown) are received in side portions of the bottom of the slider 11 and are adapted to be moved into sliding contact with three pairs of fixed contacts 17 extending vertically from the insulating plate 16. Thus, as the slider 11 moves, the manner of connection of the movable contacts with the three pairs of fixed contacts 17 varies. The slider 11 is always biased outwardly of the casing 15 by a spring 18 having one end anchored to the front end of the slider 11, the other end being anchored to a retaining element 19 (described later). The intermediate portion of the slider 11 is centrally provided with a recess 11*b* which extends in the direction of motion of the slider to receive an end portion of the driving pin.

The aforementioned retaining element 19 is formed close to the end on the open side of the top portion of the casing 15, and lies at a position somewhat lower than the surface of the top portion. The retaining element 19 is placed horizontally in such a way that its one portion extends outwardly from the recess 11*b*. The retaining element 19 has a vertical surface 19*a* having a hooked member 20 formed thereon to receive the driving pin as shown in FIG. 8. The retaining element 19 and the hooked member 20 can be molded integrally with the casing 15.

The driving pin 12 is shaped like the letter "U" and is disposed in the direction of movement of the slider 11. One end 12*a* of the pin 12 is anchored to the hooked member 20 formed on the retaining element 19 in such a way that the pin 12 is rotatable horizontally. The intermediate portion 12*b* and the other end 12*c* are disposed in the casing 15 such that the end 12*c* is received in the heart-shaped cam groove 11*a* in the slider 11. The foremost portion of the end 12*a* of the pin anchored to the hooked member 20 extends into the recess 1*b* so as to be received thereby. The pin 12 is biased by the leaf spring 13 mounted to the underside to the top portion of the casing 15. The spring 13 is also formed by cutting a portion of a base plate 21 and bending it downward. The spring 13 is centrally provided with a rim 13*a* which is disposed substantially perpendicularly to the longitudinal direction of the pin 12 so as to bias the pin 12 when the base plate 21 is mounted in the casing 15. A frame 22 is fitted over portions of the retaining element 19 and the insulating plate 16.

The latching mechanism constructed as described above is assembled in the manner described hereinafter. First, the base plate 21 including the leaf spring 13 is mounted on the underside of the top portion of the casing 15, with the retaining element 19 and hooked member 20 previously being formed integrally with the casing. Then, one end 12*a* of the driving pin 12 is brought into engagement with the hooked member 20. The slider 11 is mounted in the casing 15 in such a way that the other end 12*c* of the pin 12 is received in cam groove 11*a* in the slider 11. Since the member 20 is in the form of a hook, the end 12*a* of the pin 12 is quite readily anchored, and the pin 12 is placed between the casing 15 and the slider 11. In this embodiment, the height of the U-shaped pin 12 is smaller than that of the conventional driving pin 2 shaped like a crank. Therefore, the height of the casing 15 is smaller than that of the conventional casing. Thereafter, the insulating plate 16 is mounted to the bottom of the casing 15. The opposite ends of the spring 18 are brought into engagement with the front end extending outwardly of the slider 11 and with the retaining element 19 on the casing 15, respectively, thus completing the assembly.

In the operation of the novel mechanism, when the slider 11 is moved against the biasing force of the spring 18, the end 12*c* of the driving pin 12 is moved in the same way as the conventional structure to latch the slider in its inward position. If the slider 11 is moved further in opposition to the action of the spring 18, the slider can be unlatched. Then, the biasing force of the spring 18 returns the slider 1 to its original position. As the slider moves in this way, the movable contacts slide across the fixed contacts 17. Thus, the contact position of the movable contacts with the three pairs of fixed contacts 17 changes, thereby performing a switching action.

As thus far described the latching mechanism comprises the substantially U-shaped driving pin whose one end is horizontally and rotatably anchored to the hooked member formed on the inner surface of the casing of the switch, the other end extending to the bottom of the heart-shaped shaped cam groove. Consequently, the height of the casing can be made equal to the reduced height of the pin. Accordingly, the height of the switch casing employing the substantially U-shaped driving pin is made smaller than the conventional switch, contributing to miniaturization of the push switch making use of the locking mechanism. Further since the retaining element on the inner surface of the casing is formed integrally with the casing in the form of a hook, it is unnecessary to insert one end of the pin into a hole extending through the base plate having the leaf spring, unlike the conventional mechanism. Rather, the pin is directly anchored to the retaining element in a simpler way. Additionally, the hooked form of the pin-retaining member greatly facilitates the anchoring operation. As such, a smaller number of steps are needed to fabricate the mechanism. As a result, the mechanism can be manufactured in an efficient way, leading to a reduction in the cost.

While the present invention has been described in detail for the purpose of illustration, it is not to be construed as limited thereby, but is intended to cover all changes and modifications within the spirit and scope thereof.

What is claimed is:

1. In a latching mechanism for a switch, including a casing having a closed end and an open end, a slider mounted through the open end of the casing so as to be slidable therein, a spring mounted to the slider to bias the slider outwardly of the casing, a heart-shaped horizontally-oriented cam groove formed in one end of the slider disposed inwardly of the casing, a driving pin disposed in the direction of movement of the slider, and a flat leaf spring mounted in the casing to bias one end of the driving pin into engagement with the cam groove, the one end of the slider being horizontally slidable in the casing between a condition where the one end of the driving pin is anchored in a latching position in the cam groove and the slider is latched in a first position, and a second condition where the one end of the driving pin is moved out of the latching position and the slider is unlatched and returned to its original position, the improvement wherein the driving pin is generally a flat, inverted U-shape having a height substantially less than a length thereof, said U-shape driving pin comprising said one end in the cam groove, its other end, and a horizontal section in between the two ends, and wherein a pin-retaining element is formed on an upper portion of the casing adjacent the open end thereof, said pin-retaining element having a vertical downwardly-extending section and a hook extending horizontally therefrom for holding said other end of the driving pin horizontally and rotatably anchored to the pin-retaining element, such that the driving pin is oriented horizontal and parallel to said slider and said one end of the driving pin is only horizontally movable in the heart-shaped cam groove, whereby the height of an upper wall of the casing above the slider can be made substantially the same as the height of the driving pin carried between the slider and said casing, and an extremely flat switch can be formed.

2. In a latching mechanism in a switch as set forth in claim 1, the further improvement wherein the slider is centrally provided with a recess extending in the direction of movement of the slider to receive said other end of the driving pin extending through said pin-retaining element.

* * * * *